US011670885B2

(12) United States Patent
Tsuchiya

(10) Patent No.: US 11,670,885 B2
(45) Date of Patent: Jun. 6, 2023

(54) TERMINAL FITTING WITH BODY PORTION INCLUDING WALLS

(71) Applicant: SUMITOMO WIRING SYSTEMS, LTD., Mie (JP)

(72) Inventor: Takahiro Tsuchiya, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 6 days.

(21) Appl. No.: 17/371,961

(22) Filed: Jul. 9, 2021

(65) Prior Publication Data

US 2022/0021145 A1 Jan. 20, 2022

(30) Foreign Application Priority Data

Jul. 14, 2020 (JP) ..... JP2020-120583

(51) Int. Cl.
*H01R 13/11* (2006.01)
*H01R 4/18* (2006.01)

(52) U.S. Cl.
CPC ..... *H01R 13/11* (2013.01); *H01R 4/185* (2013.01)

(58) Field of Classification Search
CPC ..... H01R 13/11; H01R 4/185
USPC ..... 439/884
See application file for complete search history.

(56) References Cited

U.S. PATENT DOCUMENTS 5,630,738 A * 5/1997 Ito ..... H01R 13/113 439/852
6,066,009 A * 5/2000 Yamamoto ..... H01R 13/11 439/852
6,083,033 A * 7/2000 Yamamoto ..... H01R 13/50 439/381
6,729,904 B2 * 5/2004 Nankou ..... H01R 43/16 439/744
6,817,904 B2 * 11/2004 Ishikawa ..... H01R 13/113 439/752.5
6,905,376 B2 * 6/2005 Chen ..... H01R 13/113 439/852
7,275,969 B2 10/2007 Fukaya et al.
7,347,747 B2 * 3/2008 Shimizu ..... H01R 13/11 439/852

(Continued)

FOREIGN PATENT DOCUMENTS

EP 1001492 A1 * 5/2000 ..... H01R 13/113
JP H10-247539 A 9/1998

(Continued)

*Primary Examiner* — Peter G Leigh
(74) *Attorney, Agent, or Firm* — Venjuris, P.C.

(57) ABSTRACT

A terminal fitting 10 includes a body portion 11 in the form of an angular tube. The body portion 11 includes a first wall portion 21, a second wall portion 22, a third wall portion 23 and a fourth wall portion 24 continuous in a circumferential direction. The first and second wall portions 21, 22 are continuous via a first corner portion 26. The second and third wall portions 22, 23 are continuous via a second corner portion 27. The third and fourth wall portions 23, 24 are continuous via a third corner portion 28. The fourth wall portion 24 includes restricting portions 31 to be overlapped on an end part of the first wall portion 21 opposite to the first corner portion from outside. The first wall portion includes projecting portions 42, 43 projecting outward at positions away from the restricting portions 31 toward the first corner portion.

5 Claims, 7 Drawing Sheets

(56) References Cited

U.S. PATENT DOCUMENTS

| | | | | |
|---|---|---|---|---|
| 8,905,798 | B2 * | 12/2014 | Amano | H01R 4/48 439/817 |
| 10,374,348 | B2 | 8/2019 | Tanikawa | |
| 2001/0051472 | A1 * | 12/2001 | Sato | H01R 13/11 439/852 |
| 2007/0123102 | A1 * | 5/2007 | Hara | H01R 13/113 439/595 |
| 2013/0288547 | A1 * | 10/2013 | Amano | H01R 13/11 439/852 |
| 2020/0161787 | A1 * | 5/2020 | Kitaoka | H01R 13/115 |

FOREIGN PATENT DOCUMENTS

| | | | | |
|---|---|---|---|---|
| WO | WO-9511532 | A1 * | 4/1995 | H01R 13/113 |
| WO | WO-9528020 | A1 * | 10/1995 | H01R 13/113 |
| WO | WO-2017139249 | A1 * | 8/2017 | H01R 12/68 |
| WO | WO-2019111320 | A1 * | 6/2019 | H01R 13/113 |

* cited by examiner

TERMINAL FITTING WITH BODY PORTION INCLUDING WALLS

CROSS-REFERENCE TO RELATED APPLICATIONS

This application is based on and claims priority from Japanese Patent Application No. 2020-120583, filed on Jul. 14, 2020, with the Japan Patent Office, the disclosure of which is incorporated herein in its entirety by reference.

TECHNICAL FIELD

The present disclosure relates to a terminal fitting.

BACKGROUND

Japanese Patent Laid-open Publication No. 2019-029118 discloses a terminal fitting. This terminal fitting includes an angular tube portion into which a tab is to be inserted. This angular tube portion includes a bottom wall portion, a pair of side wall portions rising from the bottom wall portion and a ceiling wall portion. The ceiling wall portion is formed by two ceiling plates extending toward each other from the upper ends of the both side wall portions and vertically overlapped. An upward movement of the tab inserted into the angular tube portion is restricted by the lower ceiling plate, and the tab presses a resilient contact piece arranged along the bottom wall portion downward. A terminal fitting provided with an angular tube portion is also disclosed in Japanese Patent Laid-open Publication Nos. 2013-229221, 2007-018763, and H10-247539.

SUMMARY

Since the terminal fitting of Japanese Patent Laid-open Publication No. 2019-029118 is formed by bending a metal plate, it is required to reduce a required amount of a material. Accordingly, it is considered to omit or simplify the upper ceiling plate of a terminal body. However, if the upper ceiling plate is omitted or simplified, a clearance is formed between the lower ceiling plate and an inner side surface of a housing with the terminal fitting accommodated in the housing. Thus, the terminal fitting may rattle.

Accordingly, the present disclosure aims to reduce rattling when a terminal fitting is accommodated into a housing while reducing a required amount of a material for forming the terminal fitting.

The present disclosure is directed to a terminal fitting with a body portion in the form of an angular tube, wherein the body portion includes a first wall portion, a second wall portion, a third wall portion and a fourth wall portion continuous in a circumferential direction, the first and second wall portions are continuous via a first corner portion, the second and third wall portions are continuous via a second corner portion, the third and fourth wall portions are continuous via a third corner portion, the fourth wall portion includes a restricting portion to be overlapped on an end part of the first wall portion opposite to the first corner portion from outside, and the first wall portion includes a projecting portion projecting outward at a position away from the restricting portion toward the first corner portion.

According to the present disclosure, it is possible to reduce rattling when a terminal fitting is accommodated into a housing while reducing a required amount of a material for forming the terminal fitting.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
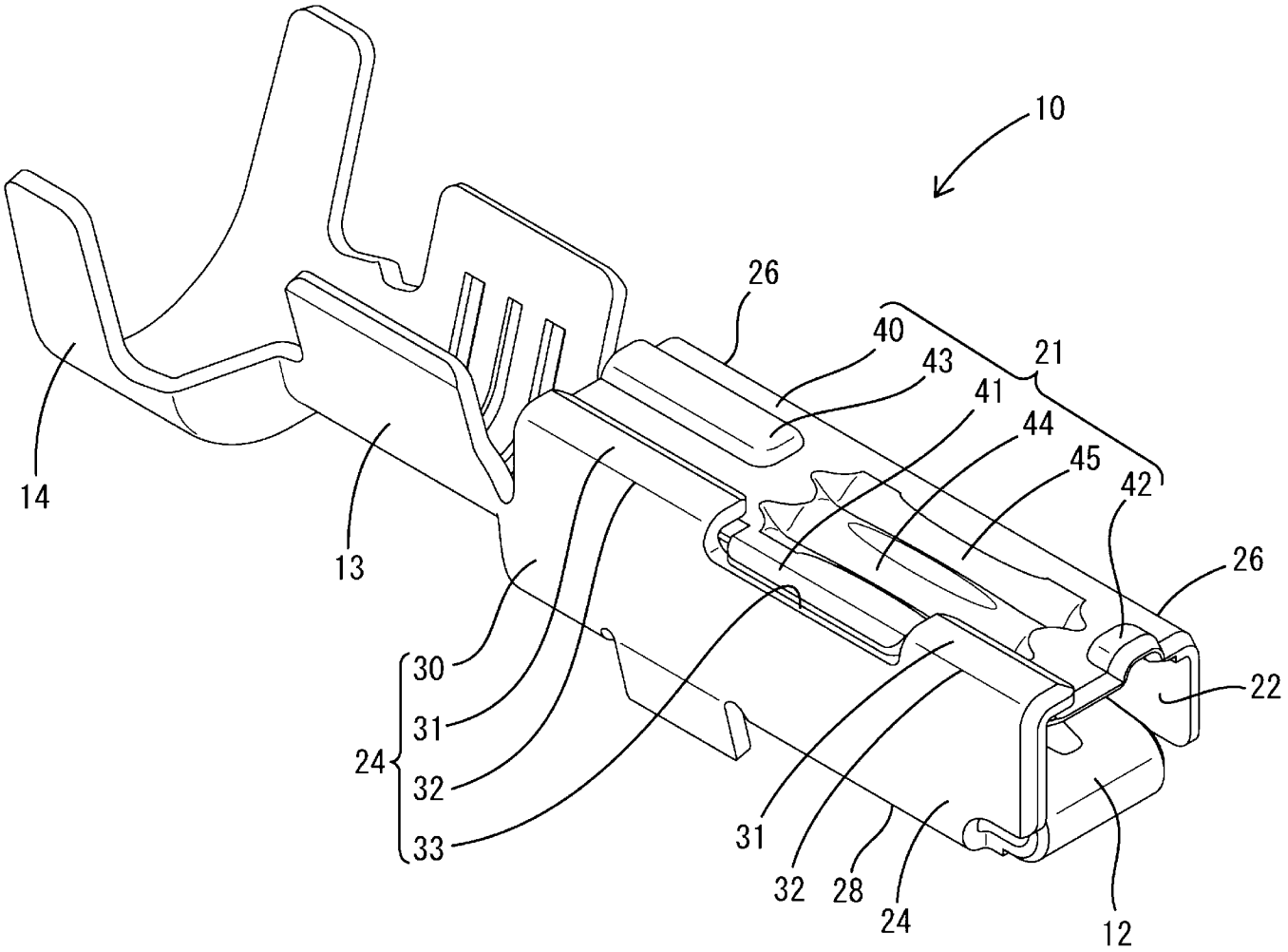
FIG. 1 is a perspective view of a terminal fitting according to one embodiment when viewed from above.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The terminal fitting of the present disclosure includes a body portion in the form of an angular tube, wherein the body portion includes a first wall portion, a second wall portion, a third wall portion and a fourth wall portion continuous in a circumferential direction, the first and second wall portions are continuous via a first corner portion, the second and third wall portions are continuous via a second corner portion, the third and fourth wall portions are continuous via a third corner portion, the fourth wall portion includes a restricting portion to be overlapped on an end part of the first wall portion opposite to the first corner portion from outside, and the first wall portion includes a projecting portion projecting outward at a position away from the restricting portion toward the first corner portion.

In this terminal fitting, an outward displacement of the first wall portion can be restricted by the restricting portion of the fourth wall portion. Thus, a required amount of a material can be reduced as compared to a configuration in which a wall portion continuous with the fourth wall portion is overlapped on the entire first wall portion. Further, the first wall portion includes the projecting portion projecting outward at the position away from the restricting portion toward the first corner portion. Thus, when this terminal fitting is accommodated into a housing, a clearance between the terminal fitting and an inner side surface of the housing is reduced and rattling is suppressed also at the position of the first wall portion away from the restricting portion toward the first corner portion. Therefore, according to this terminal fitting, the required amount of the material can be reduced while the rattling of the terminal fitting is suppressed.

(2) Preferably, the projecting portion is arranged at a position away from the first corner portion in the first wall portion.

The projecting portion of this terminal fitting is arranged at the position away from the first corner portion in the first wall portion. Thus, the projecting portion can be formed in this terminal fitting in advance, such as by striking, before bending is applied (i.e. in a developed state). Therefore, this terminal fitting is easily manufactured.

(3) Preferably, a projecting end of the projecting portion is at the same height position as an outer side surface of the restricting portion.

Since the projecting end of the projecting portion is at the same height position as the outer side surface of the restricting portion in this terminal fitting, the clearance between the projecting portion and the housing inner side surface is further suppressed to be small. Thus, rattling can be more reliably suppressed according to this terminal fitting.

(4) Preferably, the body portion has open front and rear surfaces, the first wall portion includes a recess recessed inwardly, and the projecting portion is arranged in at least one of regions forward of and rearward of the recess.

The projecting portion of this terminal fitting is arranged in at least one of the regions forward of and rearward of the recess. Thus, according to this terminal fitting, the rattling of the terminal fitting can be suppressed while the spread of the first wall portion in a width direction is suppressed. Further, the rattling of the terminal fitting to inclined back and forth in the housing can be suppressed.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

A female terminal fitting 10 to be connected to a mating male terminal fitting is illustrated in one embodiment. The terminal fitting is connected to the mating terminal fitting by inserting a tab 90 (see FIG. 5) of the mating terminal fitting into a body portion 11 to be described later.

Figure 3:
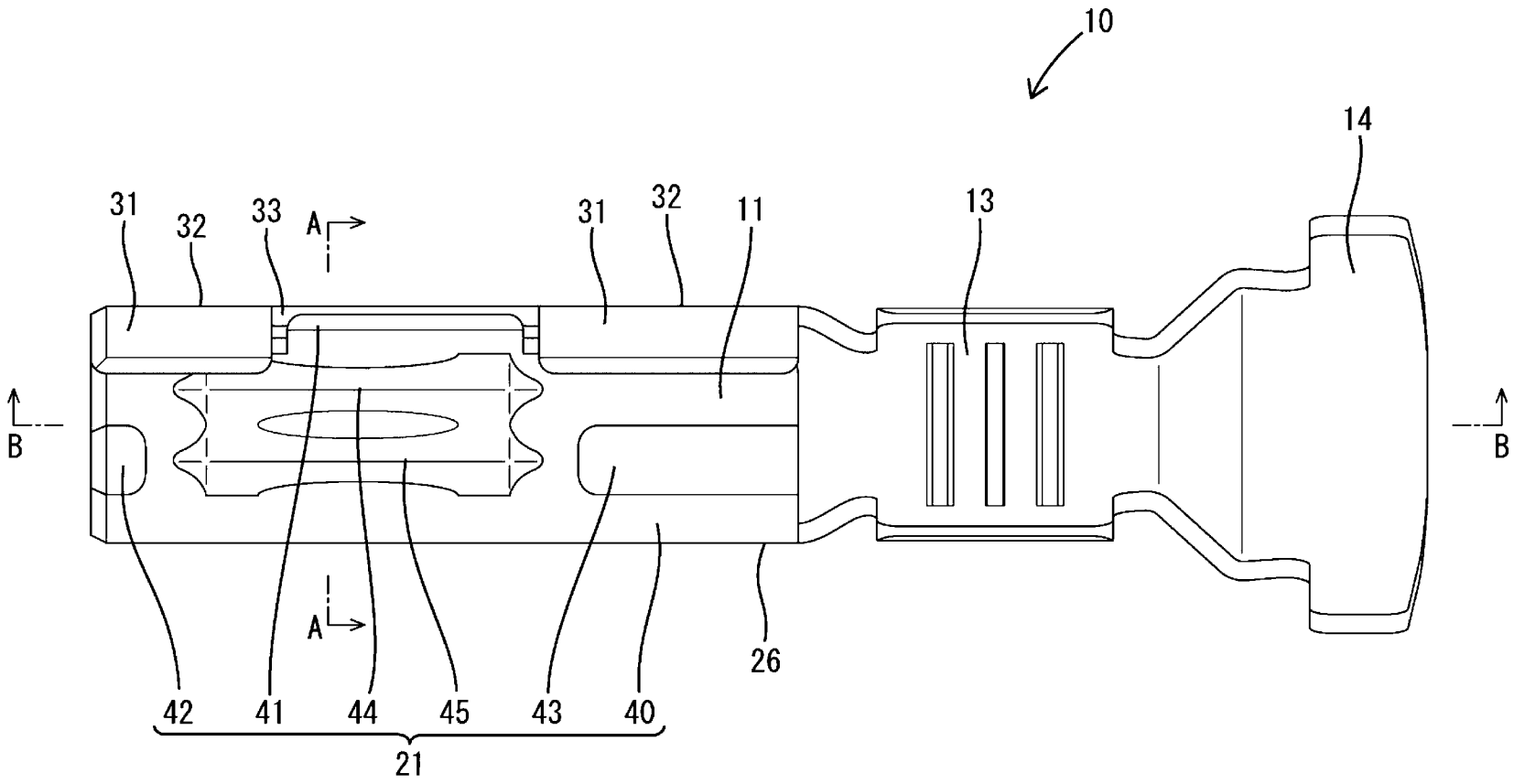
FIG. 3 is a plan view of the terminal fitting according to the one embodiment.

Note that, in the following description, a vertical direction is based on a vertical direction in FIGS. 4, 5 and 7. A left side and a right side shown in FIGS. 3 and 5 are referred to as a front side and a rear side concerning a front-rear direction. An upper side and a lower side shown in FIG. 3 are referred to as a left side and a right side concerning a lateral direction, and the lateral direction is based on a lateral direction shown in FIGS. 4 and 7. That is, in the terminal fitting 10, a side into which the tab 90 is inserted is a front side, and an opposite side thereto is a rear side. Further, directions intersecting (e.g. orthogonal to) an inserting direction of the tab 90 are the vertical and lateral directions. Further, the vertical and lateral directions intersect (e.g. are orthogonal to) each other.

Figure 2:
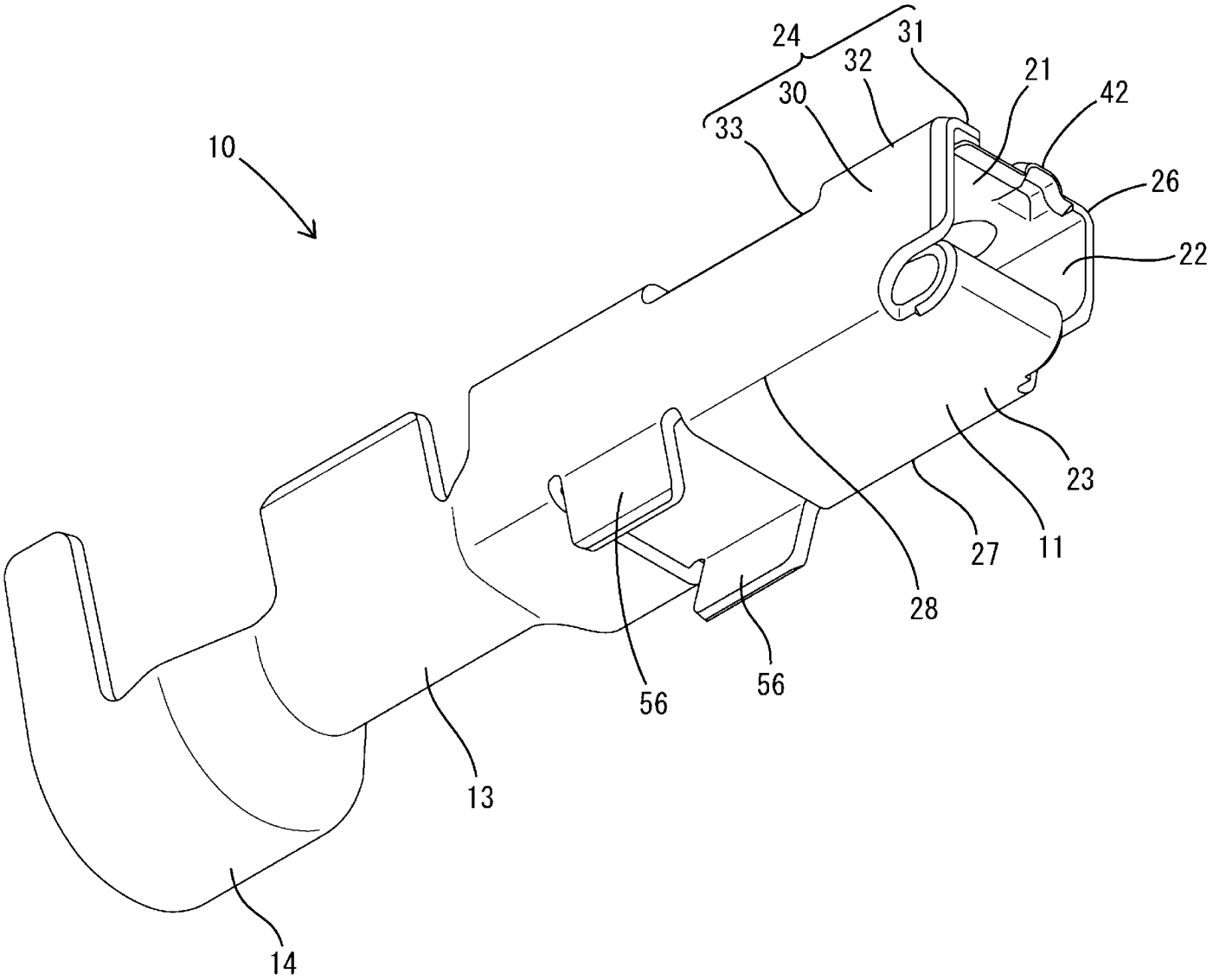
FIG. 2 is a perspective view of the terminal fitting according to the one embodiment when viewed from below.
Figure 6:
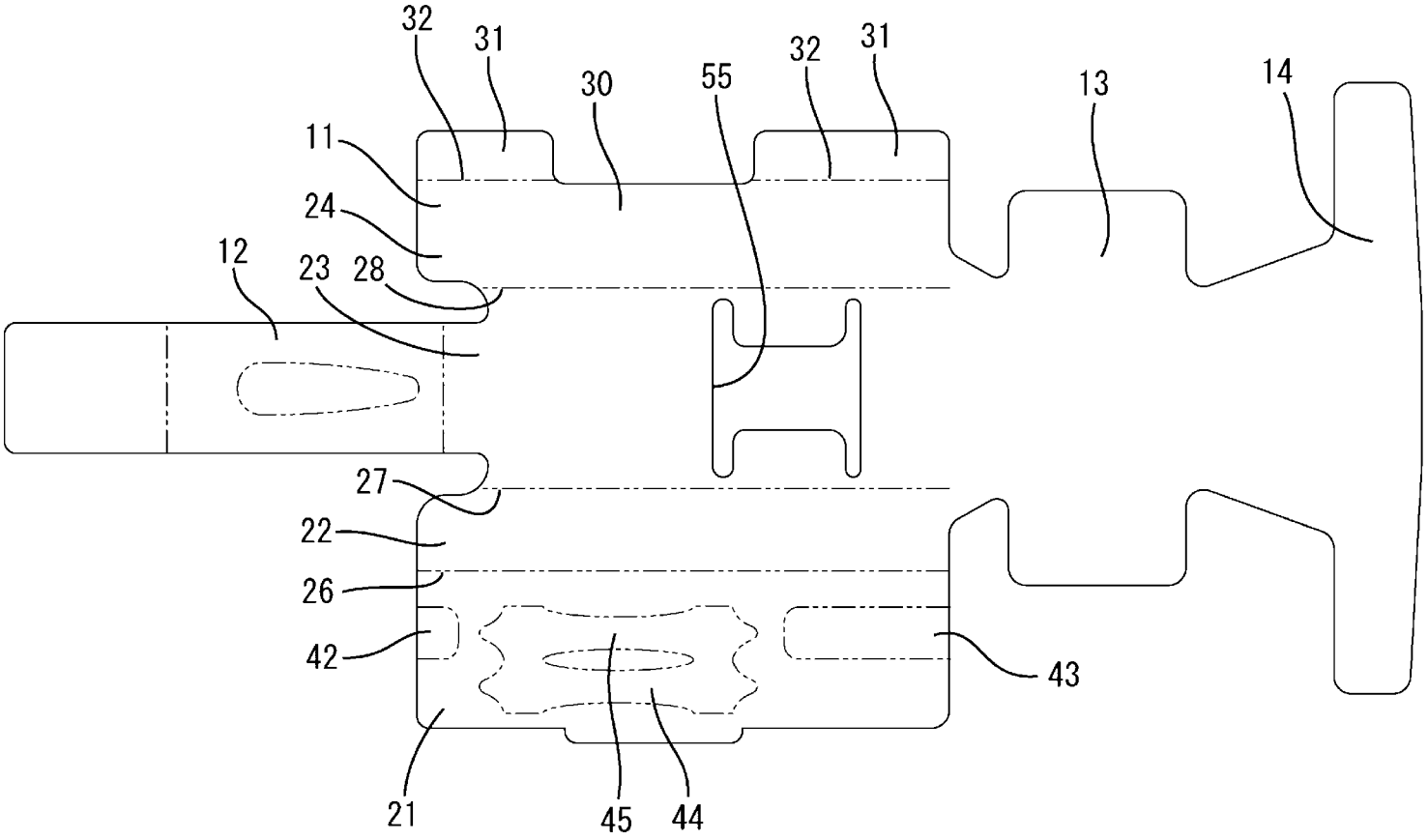
FIG. 6 is a development of the terminal fitting according to the one embodiment.

The terminal fitting 10 is integrally formed, such as by bending, after a conductive metal plate is stamped into a developed shape shown in FIG. 6. As shown in FIGS. 1 and 2, the terminal fitting 10 includes the body portion 11, a touching portion 12, a wire barrel 13 and an insulation barrel 14. The body portion 11 is in the form of an angular tube (rectangular tube in this embodiment) with open front and rear surfaces.

As shown in FIG. 5, the touching portion 12 is a part to be brought into contact with the tab 90, and arranged inside the body portion 11. The touching portion 12 is formed by folding a part projecting forward from the front end of a wall portion (third wall portion 23 to be described later in this embodiment) constituting the body portion 11 rearward, and is resiliently deformable in the vertical direction. When being inserted into the body portion 11, the tab 90 is sandwiched between the touching portion 12 and recesses 44, 45 to be described later and the terminal fitting 10 and the mating terminal fitting are electrically connected.

As shown in FIG. 5, the wire barrel 13 is a part to be connected to a conductor 93 of a wire 92, and arranged rearward of the body portion 11. The wire barrel 13 is in the form of an open barrel, and crimped to the conductor 93 exposed by removing a coating 94 in a tip part of the wire 92. The insulation barrel 14 is a part to be connected to the coating 94 of the wire 92 and arranged rearward of the wire barrel 13. The insulation barrel 14 is in the form of an open barrel, and crimped to the coating 94 of the wire 92. In this way, the wire 92 is connected to a part of the terminal fitting 10 rearward of the body portion 11.

Figure 4:
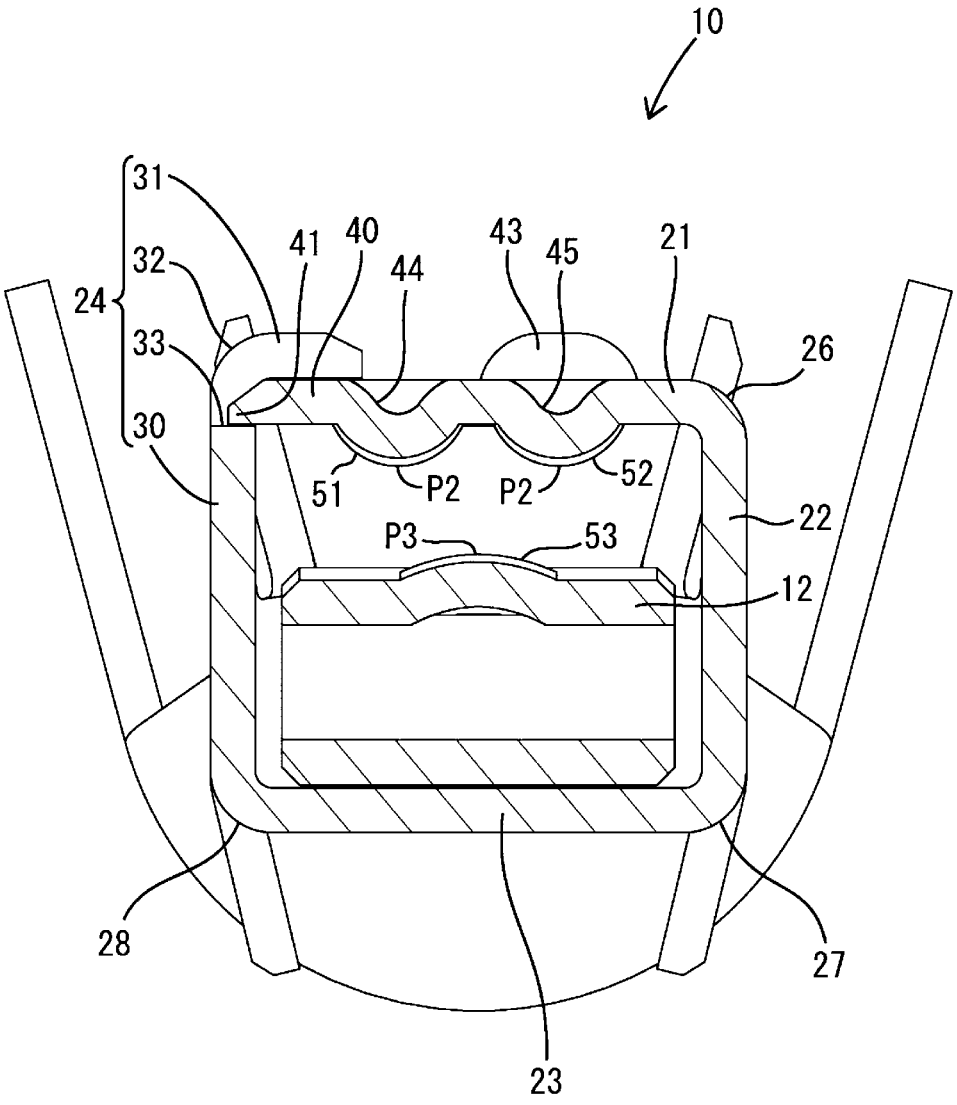
FIG. 4 is a section along A-A of FIG. 3.
Figure 5:
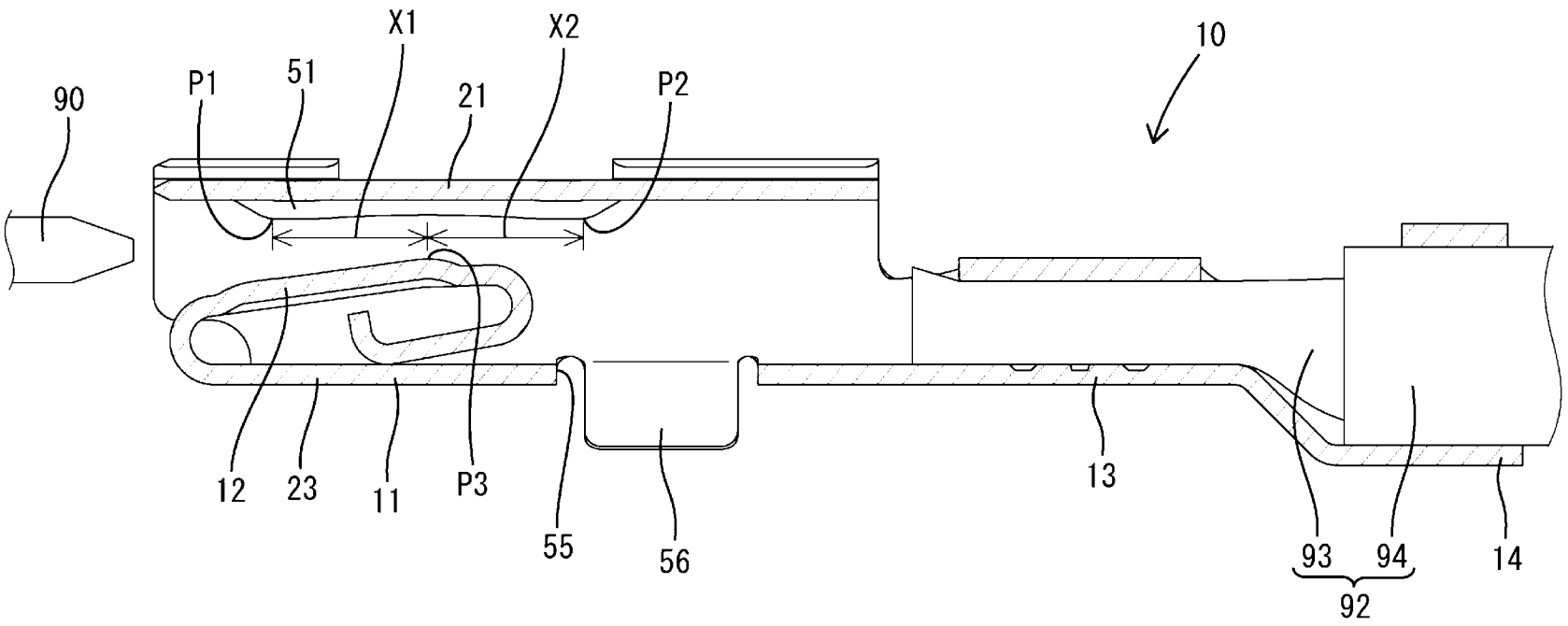
FIG. 5 is a section along B-B of FIG. 3 with a wire.

As shown in FIGS. 1, 2 and 4, the body portion 11 includes a first wall portion 21, a second wall portion 22, the third wall portion 23, a fourth wall portion 24, a first corner portion 26, a second corner portion 27 and a third corner portion 28. The first, second, third and fourth wall portions 21, 22, 23 and 24 are successively arranged in a circumferential direction (clockwise direction in a front view in this embodiment) and continuous in the circumferential direction. The first and second wall portions 21, 22 are connected at a right angle via the first corner portion 26. The second and third wall portions 22, 23 are connected at a right angle via the second corner portion 27. The third and fourth wall portions 23, 24 are connected at a right angle via the third corner portion 28. The first and third wall portions 21, 23 extend along the lateral direction and constitute both upper and lower sides of the body portion 11. The second wall portion 22 and the fourth wall portion 24 (more specifically, a later-described second base portion 30 of the fourth wall portion 24) extend along the vertical direction and constitute both left and right sides of the body portion 11.

As shown in FIGS. 1, 2 and 4, the fourth wall portion 24 includes the second base portion 30, restricting portions 31, a fourth corner portion 32 and a lock receiving portion 33. The second base portion 30 is the form of a flat surface extending along the vertical direction. The restricting portions 31 are connected at a right angle to the second base portion 30 via the fourth corner portion 32. The restricting portions 31 are continuous with an end part of the second base portion 30 opposite to the third corner portion 28. The restricting portions 31 extend along the lateral direction and are arranged outside an end part of the first wall portion 21 opposite to the first corner portion 26. Lateral widths of the restricting portions 31 are smaller than a lateral width (more specifically, half the lateral width) of the first wall portion 21. The restricting portions 31 are overlapped on the end part of the first wall portion 21 opposite to the first corner portion 26 from outside, thereby restricting the opening of the body portion 11. The restricting portions 31 are arranged on both front and rear sides of the body portion 11 and the lock receiving portion 33 is arranged between the both front and rear restricting portions 31. The lock receiving portion 33 is arranged on a side opposite to the restricting portions 31 with respect to the first wall portion 21.

As shown in FIGS. 1, 3 and 4, the first wall portion 21 includes a first base portion 40, a locking portion 41, a first projecting portion 42, a second projecting portion 43, a first recess 44 and a second recess 45. The first base portion 40 is in the form of a flat surface extending along the lateral direction. The first base portion 40 is continuous with the first corner portion 26 and arranged inside the restricting portions 31. That is, the first corner portion 26 and the first base portion 40 are arranged at a height position lower than the inner side surfaces of the restricting portions 31. In other words, the first corner portion 26 is bent at the height position lower than the inner side surfaces of the restricting portions 31. If the first corner portion 26 is bent at the same height position as the restricting portions 31, the first wall portion 21 (first base portion 40) needs to be bent to be arranged inside the restricting portions 31. However, that is not necessary according to this configuration.

The locking portion 41 is provided in a central part in the front-rear direction, out of an end part of the first base portion 40 opposite to the first corner portion 26, and shaped to project in a direction away from the first corner portion 26. The lock receiving portion 33 is arranged inside the locking portion 41, and an inward movement of the locking portion 41 is restricted by the lock receiving portion 33. That is, the end part of the first wall portion 21 opposite to the first corner portion 26 is arranged between the restricting portions 31 and the lock receiving portion 33 in a thickness direction of the first wall portion 21. Thus, movements of the end part of the first wall portion 21 opposite to the first corner portion 26 toward both sides along the thickness direction of the first wall portion 21 are restricted.

As shown in FIGS. 1 and 3, the first and second projecting portions 42, 43 (hereinafter, also referred to as the projecting portions 42, 43) project outward at positions away from the restricting portions 31 toward the first corner portion 26. The projecting portions 42, 43 are formed, for example, by being struck, and bent or curved outward into a U shape, and both ends thereof are connected to the first base portion 40. The projecting portions 42, 43 are arranged between the first corner portion 26 and the restricting portions 31 in the first wall portion 21. The projecting portions 42, 43 are arranged at positions closer to the first corner portion 26 than a lateral center of the body portion 11. The lateral positions of the projecting portions 42, 43 are aligned with each other. The lateral positions of the projecting portions 42, 43 are aligned with that of the second recess 45. That is, formation regions in the lateral direction of the projecting portions 42, 43 and the second recess 45 overlap in a front view. Projecting ends of the projecting portions 42, 43 are at the same height position as the outer side surfaces of the restricting portions 31 as shown in FIG. 4.

As shown in FIGS. 1 and 3, the first projecting portion 42 is arranged in a region forward of the first and second recesses 44, 45 (hereinafter, also referred to as the recesses 44, 45). The first projecting portion 42 is formed to extend rearward from the front end of the first wall portion 21 and has an open front surface. The second projecting portion 43 is arranged in a region rearward of the recesses 44, 45. The second projecting portion 43 is formed to extend forward from the rear end of the first wall portion 21 and has an open rear surface. A length in the front-rear direction of the second projecting portion 43 is longer than that of the first projecting portion 42.

The recesses 44, 45 are so-called beads. As shown in FIGS. 1, 3 and 4, the recesses 44, 45 are recessed inwardly in the first wall portion 21. The recesses 44, 45 are formed, for example, by being struck, and bent or curved inward into a U shape, and both ends thereof are connected to the first base portion 40. Each of the recesses 44, 45 has a shape long in the front-rear direction. The recesses 44, 45 have the same shape and are arranged side by side in the lateral direction. The first recess 44 is located at a position more away from the first corner portion 26 of the first wall portion 21 than the second recess 45. The recesses 44, 45 are so arranged that centers in the front-rear direction thereof are separated from each other, and both front and rear sides thereof are continuously formed. The recesses 44, 45 are arranged at positions near a front side of the first wall portion 21.

As shown in FIGS. 4 and 5, the first wall portion 21 includes a first contact portion 51 and a second contact portion 52 (hereinafter, also referred to as the contact portions 51, 52). The touching portion 12 includes a third contact portion 53. Each of the contact portions 51, 52 projects inwardly of the first wall portion 21. The first contact portion 51 is formed on the lower surface of the first recess 44, and the second contact portion 52 is formed on the lower surface of the second recess 45. Each of the contact portions 51, 52 has a first contact point P1 on a front side and a second contact point P2 on a rear side to be brought into contact with the tab 90 on both end parts in the front-rear direction of the recesses 44, 45. The third contact portion 53 is formed, for example, by being struck, and projects toward the first wall portion 21 from the touching portion 12. The third contact portion 53 has a third contact point P3 to be brought into contact with the tab 90. The third contact point P3 is arranged between the first and second contact points P1, P2 in the lateral direction and at a position more away from the first wall portion 21 than the first and second contact points P1, P2 in the vertical direction. A distance X1 in the front-rear direction between the first and third contact portions P1, P3 is equal to a distance X2 in the front-rear direction between the third and second contact points P3, P2.

As shown in FIG. 5, the third wall portion 23 includes a lance receiving portion 55 for receiving a locking lance 62 of a housing 60. The third wall portion 23 includes an opening open on a side opposite to the first wall portion 21, and the lance receiving portion 55 is formed on the front end of this opening.

As shown in FIG. 2, the body portion 11 is provided with stabilizers 56. The stabilizers 56 project toward a side opposite to the first wall portion 21 from end parts of the second and fourth wall portions 22, 24 opposite to the first wall portion 21.

A manufacturing method of the terminal fitting 10 is described below.

First, the metal plate is stamped into the developed shape shown in FIG. 6. The metal plate having this developed shape is struck to form the projecting portions 42, 43 and the recesses 44, 45. Thereafter, bending is applied to form the touching portion 12, and the body portion 11 is formed after the touching portion 12 is formed. In forming the body portion 11, the first, second, third and fourth corner portions 26, 27, 28 and 32 are successively formed by being bent at a right angle. That is, the first wall portion 21, the second wall portion 22, the third wall portion 23, the second base portion 30 and the restricting portions 31 are successively formed. The restricting portions 31 are arranged to overlap on the end part of the first wall portion 21 opposite to the first corner portion 26 from outside. Note that the wire barrel 13 and the insulation barrel 14 may be formed before or after the body portion 11 is formed as long as being formed after the projecting portions 42, 43 and the recesses 44, 45 are formed. Note that conventional terminal fittings had a poor material yield since having a part extending to the left of and continuously with the restricting portions 31 shown in FIG. 6.

The terminal fitting 10 manufactured in this way is connected to the wire 92. Specifically, as shown in FIG. 5, the wire barrel 13 is crimped to the conductor 93 exposed by removing the coating 94 of the wire 92, and the insulation barrel 14 is crimped to the coating 94 of the wire 92. The terminal fitting 10 connected to the wire 92 is inserted into the housing 60 from behind the housing 60 (see FIG. 7). If the terminal fitting 10 is inserted in an improper posture, the stabilizers 56 interfere with the housing 60. Thus, the insertion of the terminal fitting 10 in the improper posture is prevented. The terminal fitting 10 inserted in a proper posture is accommodated into a cavity 61 of the housing 60 as shown in FIG. 7. Rearward withdrawal of the terminal fitting 10 accommodated in the cavity 61 is prevented by the lance receiving portion 55 being hooked by the locking lance 62 of the housing.

Figure 7:
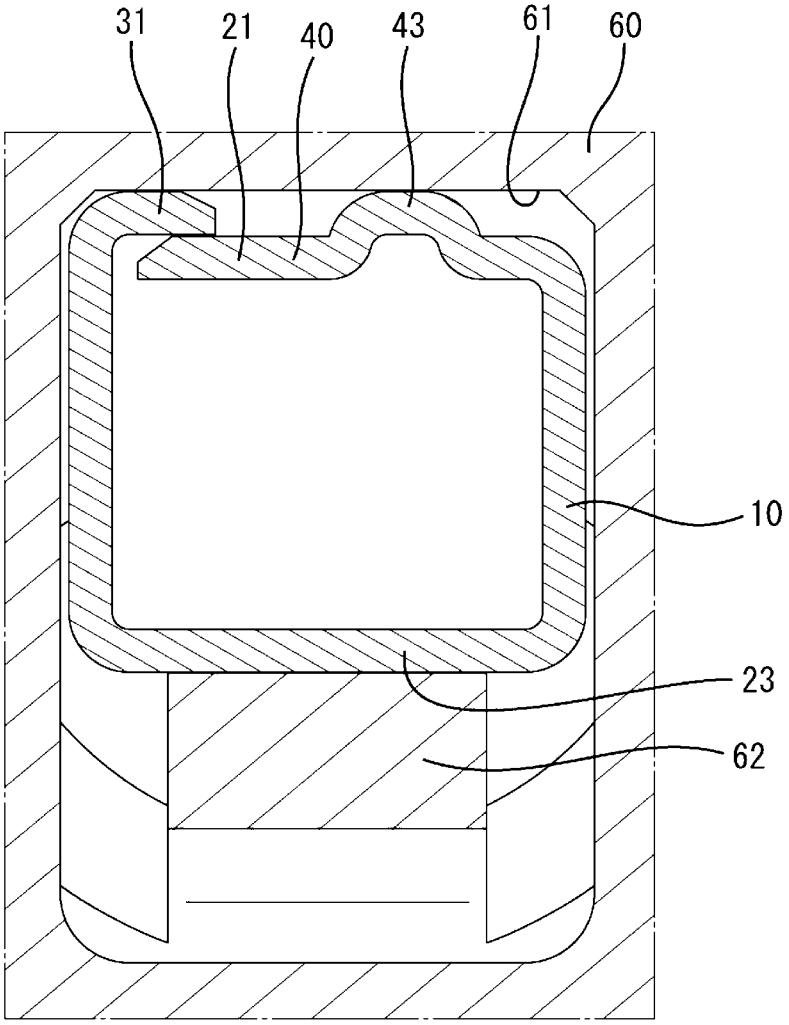
FIG. 7 is a section showing a state where the terminal fitting is accommodated in a housing.

FIG. 7 is a section of a part including the second projecting portion 43 of the terminal fitting 10 accommodated in the cavity 61. In FIG. 7, the third wall portion 23 of the terminal fitting 10 is arranged on the upper surface of a base end part of the locking lance 62. As shown in FIG. 7, a clearance is formed between the first base portion 40 of the first wall portion 21 and an inner side surface of the locking lance 61. However, the second projecting portion 43 projects toward the inner side surface of the cavity 61. Thus, the clearance between the first wall portion 21 and the inner side surface of the cavity 61 is reduced. Particularly, a projecting end of the second projecting portion 43 is at the same height position as the outer side surface of the restricting portion 31 in the vertical direction. Thus, the clearance between the first wall portion 21 and the inner side surface of the cavity 61 is further reduced. Therefore, the rattling of the terminal fitting 10 in the circumferential and vertical directions is suppressed.

Although not described in detail, a clearance formed between the first wall portion 21 and the inner side surface of the cavity 61 is reduced and the rattling of the terminal fitting 10 is suppressed also in a part including the first projecting portion 42 of the terminal fitting 10, similarly to the part including the second projecting portion 43. Particularly, since the first and second projecting portions 42, 43 are arranged away from each other in the front-rear direction in the first wall portion 21, the rattling of the terminal fitting 10 to incline back and force is also suppressed.

As described above, the terminal fitting 10 of this embodiment can restrict an outward displacement of the first wall portion 21 by the restricting portions 31 of the fourth wall portion 24. Thus, a required amount of a material can be reduced as compared to a configuration in which a wall portion continuous with the fourth wall portion 24 is overlapped on the entire first wall portion 21. Further, the first wall portion 21 includes the projecting portions 42, 43 projecting outward at the positions away from the restricting portions 31 toward the first corner portion 26. Thus, when this terminal fitting 10 is accommodated into the housing 60, the clearance between the terminal fitting 10 and the inner side surface of the housing 60 is reduced and rattling is suppressed also at the positions of the first wall portion 21 away from the restricting portions 31 toward the first corner portion 26. Therefore, according to this terminal fitting 10, the required amount of the material can be reduced while the rattling of the terminal fitting 10 is suppressed.

Further, the projecting portions 42, 43 of this terminal fitting 10 are arranged at the positions away from the first corner portion 26 in the first wall portion 21. Thus, the projecting portions 42, 43 can be formed in this terminal fitting 10 in advance, such as by striking, before bending is applied (i.e. in a developed state). Therefore, this terminal fitting 10 is easily manufactured.

Further, since the projecting ends of the projecting portions 42, 43 are at the same height position as the outer side surfaces of the restricting portions 31 in this terminal fitting 10, the clearances between the projecting portions 42, 43 and the inner side surface of the housing 60 are further suppressed to be small. Thus, according to this terminal fitting 10, rattling can be more reliably suppressed.

Further, the projecting portions 42, 43 of this terminal fitting 10 are arranged in the regions forward of and rearward of the recesses 44, 45. Thus, according to this terminal fitting 10, the rattling of the terminal fitting 10 can be suppressed while the spread of the first wall portion 21 in the width direction is suppressed. Particularly, since the projecting portions 42, 43 are arranged on both front and rear sides, rattling on both front and rear sides can be suppressed, with the result that the rattling of the terminal fitting 10 is more reliably suppressed.

Other Embodiments of Present Disclosure

The embodiment disclosed this time should be considered illustrative in all aspects, rather than restrictive.

(1) Although the first, second, third and fourth wall portions are successively arranged in the clockwise direction in a front view in the above embodiment, these may be successively arranged in a counterclockwise direction.

(2) Although the projecting portions are arranged at the positions away from the first corner portion in the first wall portion in the above embodiment, the projecting portions may be integrally formed to the first corner portion.

(3) Although the projecting ends of the projecting portions are at the same height position as the outer side surfaces of the restricting portions in the above embodiment, these may not be at the same height position as or at a height position lower or higher than the outer side surfaces of the restricting portions.

(4) Although the projecting portions are arranged in the regions both forward of and rearward of the recesses in the above embodiment, the projecting portions may be arranged only in a front region or only in a rear region.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A terminal fitting, comprising:

a body portion in the form of an angular tube having open front and rear surfaces, wherein:

the body portion includes a first wall portion, a second wall portion, a third wall portion and a fourth wall portion continuous in a circumferential direction, the first and second wall portions are continuous via a first corner portion, the second and third wall portions are continuous via a second corner portion, the third and fourth wall portions are continuous via a third corner portion, the fourth wall portion includes a restricting portion to be overlapped on an end part of the first wall portion opposite to the first corner portion from outside, the first wall portion includes a recess recessed inwardly and a projecting portion projecting outward at a position away from the restricting portion toward the first corner portion, and the projecting portion is arranged in at least one of regions forward of and rearward of the recess.

2. The terminal fitting according to claim 1, wherein the projecting portion is arranged at a position away from the first corner portion in the first wall portion.

3. The terminal fitting according to claim 1, wherein a projecting end of the projecting portion is at the same height position as an outer side surface of the restricting portion.

4. The terminal fitting according to claim 1, wherein the projecting portion includes a first projecting portion having an open surface continuous with the open front surface of the body portion and a second projecting portion having an open surface continuous with the open rear surface of the body portion, and the recess is arranged between the first projection portion and the second projection portion on the first wall portion.

5. The terminal fitting according to claim 1, wherein the fourth wall includes a second base portion continuous with the restricting portion via a fourth corner portion, and the first corner portion is lower than the fourth corner portion.

* * * * *